US005337914A

United States Patent [19]

Mulder

[11] Patent Number: 5,337,914

[45] Date of Patent: Aug. 16, 1994

[54] LINED CONTAINER

[75] Inventor: Jan W. Mulder, Auckland, New Zealand

[73] Assignee: Rohm and Haas Company, Philadelphia, Pa.

[21] Appl. No.: 971,802

[22] Filed: Nov. 5, 1992

[30] Foreign Application Priority Data

Nov. 19, 1991 [NZ] New Zealand ..... 240645

[51] Int. Cl.[5] ..... B65D 25/00

[52] U.S. Cl. ..... 220/403; 220/404; 220/461; 220/470

[58] Field of Search ..... 220/403, 404, 461, 470

[56] References Cited

U.S. PATENT DOCUMENTS

| | | | |
|---|---|---|---|
| 1,488,203 | 3/1924 | Horne et al. | 220/403 |
| 1,591,373 | 7/1926 | Griffiths | 220/461 |
| 2,082,760 | 6/1937 | Berni | 220/461 X |
| 2,511,481 | 6/1950 | Schneider | 220/461 |
| 2,727,673 | 12/1955 | Bergstrom | 220/461 X |
| 2,912,136 | 11/1959 | Redmond et al. | 220/404 |
| 3,015,410 | 1/1962 | Everett et al. | 220/404 X |
| 3,158,311 | 11/1964 | Thompson | 220/404 X |
| 3,443,735 | 5/1969 | Meijers | 220/404 X |
| 4,117,951 | 10/1978 | Winckler | 220/461 |
| 4,191,305 | 3/1980 | Davis | 220/461 X |
| 4,700,867 | 10/1987 | Dutt et al. | 220/461 X |

*Primary Examiner*—Steven M. Pollard

[57] ABSTRACT

A lined container which provides chemical resistance, is inexpensive and provides maximum cubic capacity in the container is disclosed. The liner is supported from the container and has an engagement means for securing the liner to the container when the liner is located within the container.

5 Claims, 1 Drawing Sheet

LINED CONTAINER

FIELD OF THE INVENTION

This invention relates to a lined container, and more particularly to a container having a liner which provides chemical resistance.

BACKGROUND OF THE INVENTION

A container, such as a closed head steel drum, may be required to be resistant to chemicals which will be transported and stored in the container. Two methods currently achieve this chemical resistance. The first method involves coating the inner surfaces of the container with an epoxy coating. The second method involves mechanically inserting a heavy, inflexible liner, such as for example by blow molding a plastic inside the container before a lid is rolled in place.

In the first method, the epoxy lining may crack if the container is knocked, causing chemical leakage within the container and possibly corrosion and leakage of the chemical outside of the container. In the second method, the blow moulded lining is expensive and does not always conform closely to the inner surface of the steel container, resulting in air pockets remain that reduce the cubic capacity of the container.

SUMMARY OF THE INVENTION

The present invention relates a lined container which provides chemical resistance, is inexpensive and provides maximum cubic capacity in the container. The liner is supported from the container and has an engagement means for securing the liner to the container when the liner is located within the container.

DETAILED DESCRIPTION OF THE INVENTION

According to a first aspect of the present invention there is provided a liner for a container where the liner is supported from the container, and the liner has engagement means for securing the liner to the container when the liner is located within the container.

According to a second aspect of the present invention there is provided a drum having a liner located within a container where the liner is supported from the container and the liner and container are secured to each other by means of mutually co-operable engagement means.

In a third aspect the invention is a liner of a suitable plastic material for a container. The liner has a hollow cylindrical portion and a top and a bottom end member. Each end member of the liner contains a disc and has at least portions of periphery thereof arranged to be engageable with and in use retained by a rolled edge or equivalent mechanical joint on the container. The construction and arrangement is such that the container can be assembled with the liner within the cylindrical portion of the container and with at least portions of periphery of the liner overlapping the edges of the cylindrical portion of the liner. The top and bottom members of the liner are joined to the cylindrical portion of the liner by the rolled edge or its mechanical equivalent.

The rolled edge is such that periphery of each end member of the liner is rolled into the joint in a manner such that no material tearing of the liner occurs as a result of the rolling operation, but the liner is retained by the engagement of the periphery of the liner in the rolled edge joints.

In a further aspect the invention is a container having a liner as aforesaid, the container being assembled by placing a liner in a cylindrical portion of the container, placing a top and bottom disc container member on the cylindrical portion, the flaps of the liner extending beyond the internal diameter of the cylindrical portion and the flap members being rolled with the end edges of the cylindrical portion with the peripheries of the container disc members and the flaps included in the rolled joint so that the liner is retained in position by engagement of the flaps in the rolled joint and the flaps being of a number such and positioned in a manner such that no material tearing of the liner occurs during the manufacture of the joints of the container.

Many changes in construction and widely differing embodiments and applications of the invention will suggest themselves without departing from the scope of the invention to those skilled in the art to which the invention relates. The disclosures and the descriptions herein are purely illustrative and are not intended to be in any sense limiting. For example, the liners may be self-supporting.

The invention consists in the foregoing and also envisages constructions of which the following gives examples.

Figure 1:
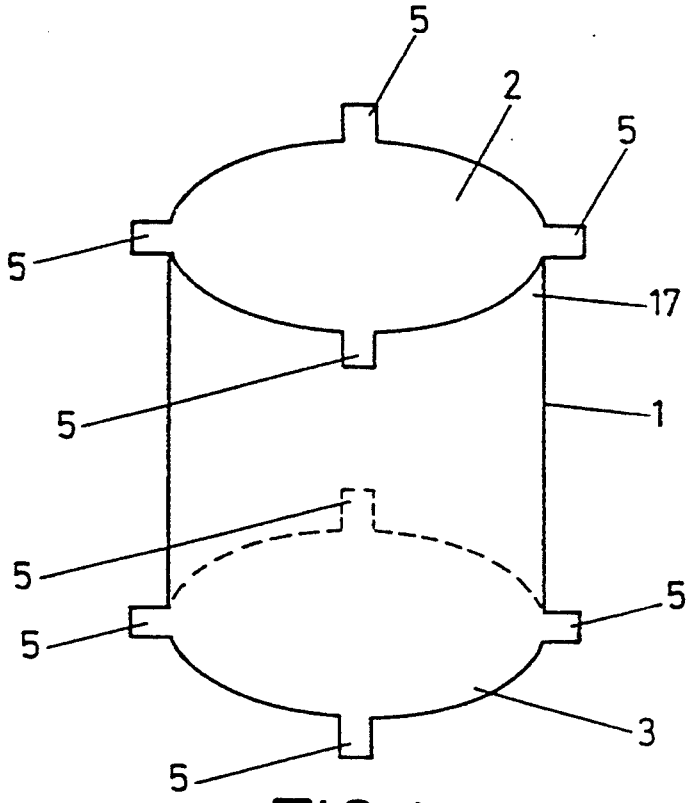
FIG. 1 is a perspective view of a liner for a container constructed according to the invention.

One preferred form of the invention will now be described with reference to the accompanying drawings in which:

FIG. 1 is a perspective view of a liner for a container constructed according to the invention.

Figure 2:
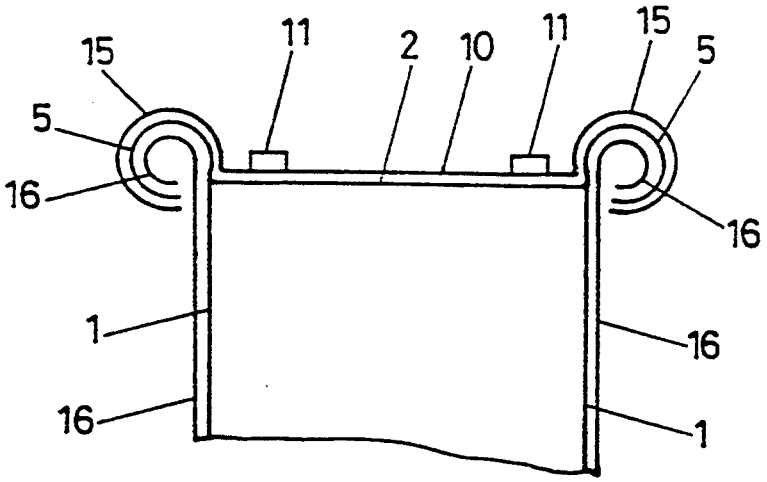
FIG. 2 is an elevation in cross section of one end of a container including a liner according to the invention.

FIG. 2 is a elevation in cross section of one end of a container including a liner according to the invention.

Referring to the drawings, a liner is made by taking a cylindrical plastic film 1, such as, for example, polyethylene, f and forming a shaped lining member for example a square of preferably cylindrical lining member 1. The thickness of the film depends on the requirements but a thickness of 0.15 mm has been found to be useful.

Two flat discs of similar plastics material, for example polyethylene film, are provided to provide a top member 2 and a bottom member 3. These members are made to suit the lining member by being provided in a disc shape for example but with at least portions of the periphery thereof being arrange to be engageable with a rolled joint, or its mechanical equivalent, between each of a container top member and bottom member and a cylindrical portion of the container. Thus, preferably, a plurality of spaced apart flaps or tabs 5 extend from the members at intervals, and in the preferred form four such tabs or flaps are provided.

The liner is completed by heat welding the members 2 and 3 to the cylindrical portion 1 with the flaps extending beyond the diameter of the cylindrical member 1. If desired the flaps or tabs 5 may be strips of plastic film adhered to the discs 2 or 3 by heat sealing or by gluing for example, or if desired the flaps or tabs 5 may be provided integrally with the discs 2 and 3. This can be effected by providing the tabs in the corners of a square sheet which is then cut to a circular contour between adjacent tabs 5.

To form a container in the form of a closed head liner steel drum, steel is formed to a cylindrical portion and the above plastics liner placed in position within the steel cylinder with the tabs extending at least to the edges of the cylindrical portion and preferably extending slightly beyond such edges. Steel discs are then provided to provide a top disc 10 and a similar bottom disc (not shown). The top disc 10 preferably is provided with two bungs 11 in the known way and preferably the bungs are protected at least on inner surfaces with a plastics material also resistant to chemicals. The drum is completed by rolling the edge 15 of each of the top and bottom discs together with the flaps 5 and the portion 16 of the top edge of the cylindrical portion into a rolled edge as shown in FIG. 2. Alternatively, if desired a mechanical equivalent of a rolled edge is provided such as a separate ring of internally facing channel formation to clamp each of the top and bottom discs onto a suitably shaped edge of the cylindrical portion. In each case it is essential that the flaps or tabs be caught in the joint.

Even though apart tabs or flaps are incorporated in each joint, by varying the joint form (for example by providing a ring as above described) or by varying the manner in which the joint is formed (for example by first fixing an annular ring of the liner disc to a container end or cylindrical member end then forming the rolled joint either continuously from one position or in sections each starting at a different position); the intention in either case is to prevent any material tearing of the liner during the making of the joint. However, according to the preferred form of the invention, with the provision of a suitable number of flaps or tabs, for example four, the liner is sufficiently supported as to enable it to be filled with a chemical or other liquid without material air pockets between the drum and the liner and without tearing of the plastics liner during the formation of the joint. The result is that a plastics liner is provided, the integrity of which is preserved during manufacture of the drum and during filling. In addition the drum can be decanted on its side without the liner collapsing at least to any material extent. Alternatively the contents of the drum can be pumped out with a lance, again without the liner blocking the inlet of the lance.

It will be apparent from the foregoing that after the drum has been made the drum is filled and can be transported without any material tendency for the contents to leak through the plastics liner (provided the heat sealing of the discs to the cylindrical portion of the liner is satisfactory), which is a major advantage. It will also be apparent that because of the thinness of the plastics material used there is a considerable saving in material and also a saving in the time required to manufacture the drum.

Where bungs are provided it is preferable to assemble the bung with the inner plastics liner onto the top with the liner 2 in place on the top before the top and liner is assembled to complete firstly the liner and then the drum.

Where an open ended liner is provided the bottom of the liner may be fixed to the drum as above described while the upper end 17 of the liner 1 is folded over the top edge of the cylindrical part of the drum, the drum filled and the top member 2 of the liner fixed to the drum lid before being releasably secured to the cylindrical part of the drum for example with a ring of inwardly facing channel to engage lips of the drum and lid.

From the foregoing it will be seen that a simple yet effective low cost chemical resisting liner is provided in a closed head drum.

I claim:

1. A lined container, comprising:

(a) a container;

(b) a liner supported from said container comprising:

(1) a hollow cylindrical portion; and (2) a top and a bottom end member; wherein each said end member comprises a disc, each said end member having at the least portion of periphery thereof arranged to be engageable with and in use retained by a rolled edge or equivalent mechanical joint on a container, the construction and arrangement being such that the container can be assembled with the liner within the cylindrical portion thereof and with at least portions of periphery of the liner overlapping the edges of the cylindrical portion and the container having each of said top and bottom members joined to the cylindrical portion by said rolled edge or its mechanical equivalent, the rolled edge being such that the at least portions of the periphery of each said end member are rolled into the joint in a manner such that no material tearing of the liner occurs as a result of the rolling operation, but the liner is retained by the engagement-of the at least parts of the periphery of said liner in the rolled edge joints and wherein said periphery portions of said end members comprise spaced apart tabs or flaps; and (c) a means for engaging said liner to said container when said liner is located within the container, wherein said engagement means comprises at least one outwardly extending tab located at at least one end of the liner.

2. The lined container according to claim 1 wherein said container and said liner are cylindrical.

3. The lined container according to claim 1 wherein said liner is made from a plastic material.

4. The lined container according to claim 1 wherein said engagement means is integral with the liner.

5. The lined container according to claim 1 wherein said liner comprises four tabs or flaps spaced equi-distantly around each of the top and bottom liner members.

* * * * *